United States Patent [19]

Haddad et al.

[11] Patent Number: 4,717,467

[45] Date of Patent: Jan. 5, 1988

[54] PROCESS FOR MIXING FLUID CATALYTIC CRACKING HYDROCARBON FEED AND CATALYST

[75] Inventors: James H. Haddad, Princeton Junction; Hartley Owen, Belle Mead, both of N.J.

[73] Assignee: Mobil Oil Corporation, New York, N.Y.

[21] Appl. No.: 50,269

[22] Filed: May 15, 1987

[51] Int. Cl.[4] ..... C10G 11/18

[52] U.S. Cl. ..... 208/113; 208/157; 208/153

[58] Field of Search ..... 208/113, 152, 153, 157, 208/163, 164, 143, 146; 422/140, 143

[56] References Cited

U.S. PATENT DOCUMENTS

| | | | |
|---|---|---|---|
| 2,905,517 | 5/1961 | Harper | 208/164 X |
| 3,408,286 | 10/1968 | Hepp | 208/164 X |
| 3,617,497 | 11/1971 | Bryson | 208/157 X |
| 3,894,932 | 7/1975 | Owen | 208/164 X |
| 3,966,586 | 6/1976 | Owen et al. | 208/78 |
| 3,974,062 | 8/1976 | Owen et al. | 208/74 |
| 4,002,557 | 1/1977 | Owen et al. | 208/111 |
| 4,012,455 | 3/1977 | Owen et al. | 585/408 |
| 4,035,285 | 7/1977 | Owen et al. | 208/74 |
| 4,051,013 | 9/1977 | Strotner | 208/153 X |
| 4,331,533 | 5/1982 | Dean et al. | 208/157 X |
| 4,427,537 | 11/1984 | Dean et al. | 208/153 X |
| 4,523,987 | 6/1985 | Denick | 208/153 X |
| 4,562,046 | 12/1985 | Hays et al. | 422/140 |

*Primary Examiner*—Curtis R. Davis
*Assistant Examiner*—Glenn Caldarola
*Attorney, Agent, or Firm*—Alexander J. McKillop; Michael G. Gilman; Malcolm D. Keen

[57] ABSTRACT

A process and apparatus for mixing fluid catalytic cracking hydrocarbon feed and catalyst is disclosed. The invention passes lift gas through a first conduit which is axially aligned with a second conduit. A downstream end of the first conduit and an upstream end of the second conduit are located within a catalyst bed enclosed by a chamber. Furthermore, the second conduit axially injects catalyst and lift gas into an upstream end of an elongated fluid catalytic cracking riser while passing hydrocarbon feed into the riser through an annular zone about the upstream end of the riser. Preferably steam also passes through this annular zone. The process and apparatus achieves substantially uniform catalyst-to-oil ratio across a horizontal cross-section of the riser. A process and apparatus for control of the level of the catalyst bed in the enclosed chamber by employing a control gas stream is also disclosed.

16 Claims, 6 Drawing Figures

PROCESS FOR MIXING FLUID CATALYTIC CRACKING HYDROCARBON FEED AND CATALYST

BACKGROUND OF THE INVENTION

1. Field of the Invention

This invention relates to a process and apparatus for fluid catalytic cracking (FCC) of a hydrocarbon feed. More particularly, it relates to a process and apparatus for axially injecting lift gas through a lift pot having conduits therein to achieve a substantially uniform ratio of catalyst to oil across a horizontal cross-section of an FCC riser.

2. Discussion of the Prior Art

The field of catalytic cracking, particularly fluid catalytic cracking, has undergone significant developments due primarily to advances in catalyst technology and product distribution obtained therefrom. With the advent of high activity catalysts and particularly crystalline zeolite cracking catalysts, new areas of operating technology have been encountered, requiring refinements in processing techniques to take advantage of the high catalyst activity, selectivity and operating sensitivity.

By way of background, the hydrocarbon conversion catalyst usually employed in an FCC installation is preferably a high activity crystalline zeolite catalyst of a fluidizable particle size. The catalyst is combined with hydrocarbon feedstock (oil) and steam and is transferred in suspended or dispersed phase condition generally upwardly through one or more conversion zones (FCC riser), providing a hydrocarbon residence time in each conversion zone in the range of 0.5 to about 10 seconds, and usually less than about 8 seconds. High temperature riser conversions, occurring at temperatures of at least 980° F. and at 0.5 to 4 seconds hydrocarbon residence time in contact with the catalyst in the FCC riser, are desirable for some operations before initiating separation of vaporous hydrocarbon product materials from the catalyst. Carbonaceous deposits accumulate on the catalyst particles, during the hydrocarbon conversion step, and the particles entrain hydrocarbon vapors upon removal from the hydrocarbon conversion step. The entrained hydrocarbons are subjected to further contact with the catalyst until they are removed from the catalyst by mechanical means or stripping gas or both in a separate catalyst stripping zone. Hydrocarbon conversion products, separated from the catalyst, and stripped materials are combined and typically pass to a product fractionation step. Stripped catalyst containing deactivating amounts of carbonaceous material, hereinafter referred to as coke, then passes to a regeneration operation.

Of particular interest has been the development of processes and systems for feeding oil, steam and catalyst into a FCC riser and improving the contact between the oil and catalyst to obtain uniform mixing as they travel up the riser.

U.S. Pat. No. 4,435,279 to Busch et al discloses charging low quality naphtha from thermal cracking either separately or in admixture with $C_5$ and lower boiling wet gas product of hydrocarbon conversion to the bottom portion of a riser conversion zone for contact with freshly regenerated zeolite cracking catalysts. The vaporous material thus charged conveys the regenerated catalyst at an acceptable velocity to an expanded section of the riser wherein residual oil is charged by a plurality of nozzles penetrating the wall of the riser in the transition section to the expanded section.

U.S. Pat. No. 3,821,103 to Owen et al discloses a fluid catalytic cracking regeneration operation wherein hot catalyst, from a fluid catalytic cracking stripping vessel, passes to a vessel housing a bed of catalyst about the inlet of a riser regenerator. Regeneration gas, such as air or air supplemented with oxygen, is introduced, by a hollow stem-plugged valve aligned with the bottom open inlet of a regenerator riser.

While the systems described above mix a catalyst and a lift gas, there still remains a need for a system which obtains as nearly as possible a uniform ratio of catalyst to oil feed across the horizontal cross-section of a riser. The present invention is directed to filling this need.

SUMMARY OF THE INVENTION

It is a primary object of this invention to provide an improved process and apparatus for feeding oil, steam and catalyst to a fluid catalytic cracking (FCC) riser, which promotes a substantially uniform ratio of catalyst to oil feed across the horizontal riser cross-section.

It is another object of the present invention to provide a process and apparatus for distributing fluid catalytic cracking catalyst uniformly around the base of a conduit through which catalyst accelerates prior to passing into a riser conversion zone.

It is another object of the present invention to provide an improved process and apparatus for feeding oil, steam and catalyst to a fluid catalytic cracking (FCC) riser which obtains an improved gasoline yield and reduced coke yield.

In its process aspects, the invention achieves the foregoing objects by passing lift gas into an enclosed chamber (lift pot) through a first vertical conduit which is axially aligned with a second vertical conduit (accelerator conduit). A downstream end of the first conduit and an upstream end of the second conduit are surrounded by a bed of regenerated catalyst. The regenerated catalyst flows from the bed into the second conduit and accelerates as it passes upwardly through the second conduit to outside of the enclosed chamber where it discharges axially into a riser. In the riser, the regenerated catalyst and lift gas are contacted with steam and hydrocarbon feedstock. Typically the hydrocarbon feedstock is vacuum gas oil (VGO) or residuum or both. The hydrocarbon feedstock may pass through an annulus around the axially discharged catalyst. Preferably the steam also passes through an annulus about the axially discharged catalyst. One way to maintain catalyst level in the enclosed chamber is by employing a control gas.

In its apparatus respects, the present invention includes a first vertical conduit for passing lift gas therethrough and a second vertical conduit (accelerator conduit) axially aligned with the first conduit. The downstream end of the first conduit and the upstream end of the second conduit are located within an enclosed chamber (lift pot). A conduit for passing regenerated catalyst into the enclosed chamber is also provided. The downstream end of the second conduit is located within, or attached to, an elongated tubular riser. The second conduit is also axially aligned with the riser. Also provided are means for distributing hydrocarbon feedstock into the riser, in an atomized or dispersed phase flow condition, uniformly around an annular region defined by an inner periphery of an upstream end of the riser. Typically the hydrocarbon feedstock is vacuum gas oil or residuum or both. The annulus may be outside or inside the downstream end of the second conduit. Preferably, means for passing steam through an annulus of the riser are also provided. Means for controlling level of a catalyst bed within the enclosed chamber may also be provided.

Other objects, advantages and process and apparatus aspects of the present invention will be more clearly understood from the following detailed description of the invention which is provided in connection with the accompanying drawings.

DETAILED DESCRIPTION OF THE INVENTION

As well known, a fluid catalytic cracking (FCC) process and apparatus employs a catalyst to promote cracking of a hydrocarbon feed. The catalyst is in the form of very fine particles which act as a fluid when aerated with a vapor. The fluidized catalyst is circulated continuously between a reaction zone and a regeneration zone and acts as a vehicle to transfer heat from the regenerator to the hydrocarbon feed and vapor. The fluid catalytic cracking process and apparatus are valuable to convert heavy hydrocarbons, e.g., vacuum gas oil or residuum, into more valuable gasoline and lighter products.

Figure 1:
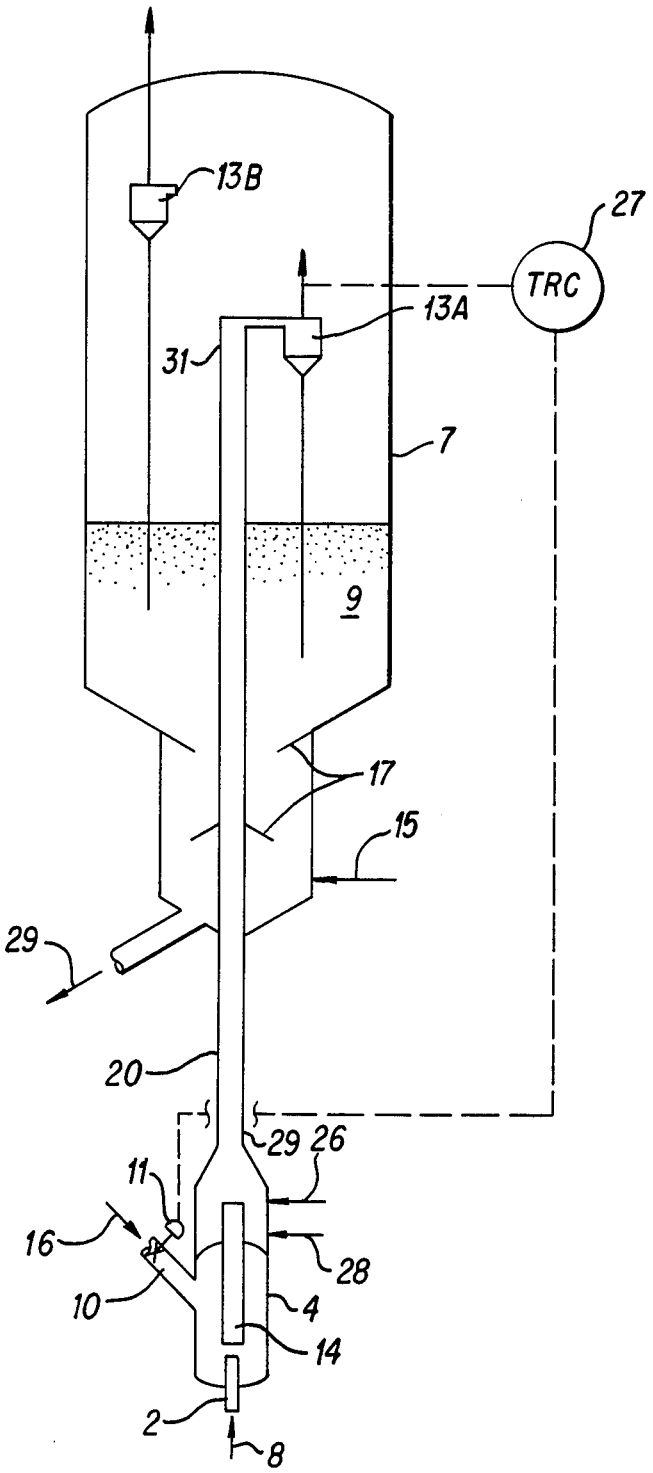
FIG. 1 is a cross-sectional view of a fluid catalytic cracking disengaging vessel and a first embodiment of the present invention for mixing fluid catalytic cracking feed and catalyst.
Figure 2:
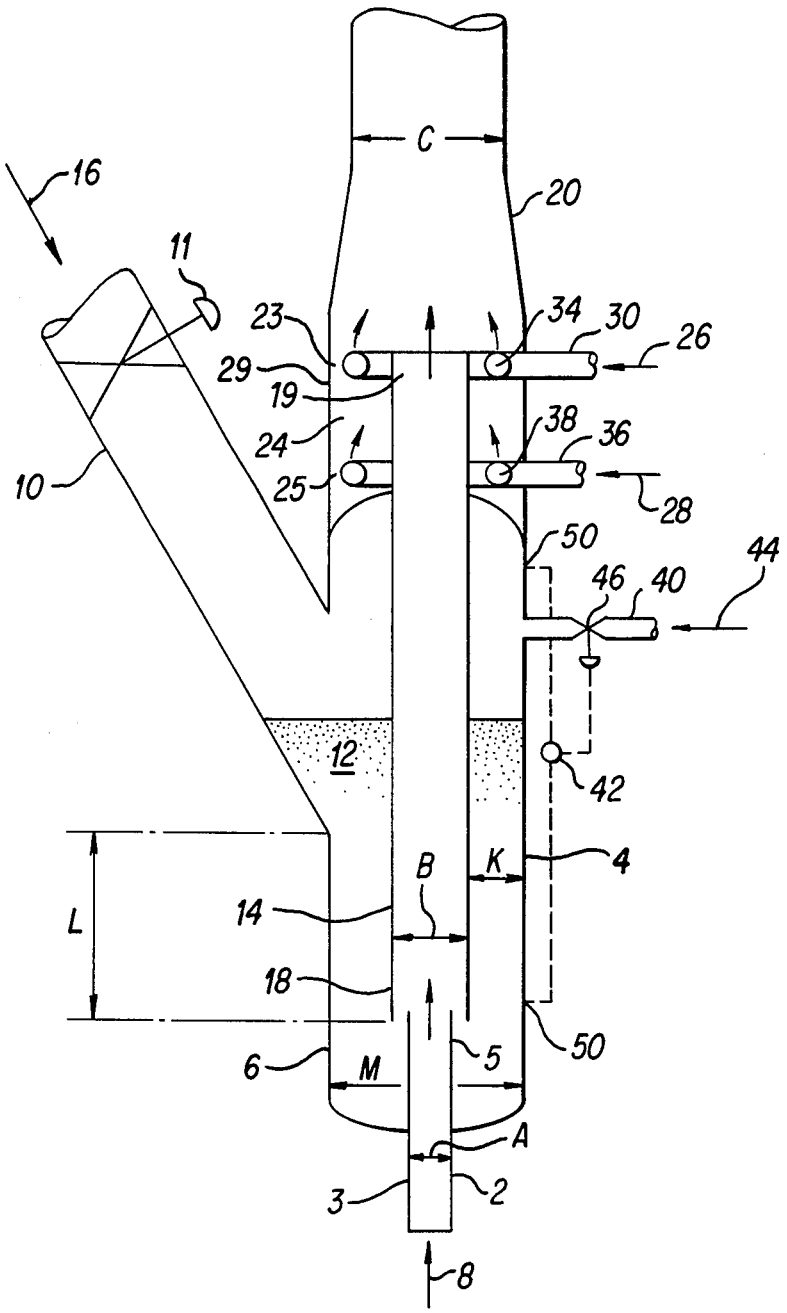
FIG. 2 is an enlarged cross-sectional view of the first embodiment of the present invention.

FIGS. 1 and 2 show a first embodiment of the apparatus for performing the process of the present invention. A lift gas stream 8 passes into the upstream end 3 of a first vertical conduit 2 which has a downstream end 5 which terminates within an enclosed chamber 4 (lift pot) having sidewalls 6. The lift gas stream 8 may comprise steam, gasoline, flue gas from a fluid catalytic cracking regenerator (not shown), fresh hydrocarbon feedstock, recycled hydrocarbon feedstock, vacuum gas oil, residuum, cracked cycle stock, fuel gas or hydrocarbons having at most 4 carbon atoms per molecule. Steam is be particularly useful with high metals content feeds where some initial deactivation might be useful. Typical hydrocarbon feedstocks in stream 26 include vacuum gas oil, or residuum, or both. Preferably, the lift gas stream 8 comprises a mixture of or hydrocarbons having at most 4 carbon atoms per molecule, steam and either residuum, virgin vacuum gas oil, or cracked cycle stock. The lift gas stream 8 discharges from the first vertical conduit 2 into the upstream end 18 of a second vertical conduit 14 (accelerator conduit). First conduit 2 is axially aligned with second conduit 14. Preferably, the inside diameter A of the downstream end 5 of the first conduit 2 is less than the inside diameter B of the upstream end 18 of the second conduit 14.

The downstream end 5 and upstream end 18 are both located within a catalyst bed 12 within the enclosed chamber 4. Catalyst for catalyst bed 12 is provided by a regenerated catalyst stream 16 which passes through a catalyst inlet conduit 10 attached to the chamber 4. Conduit 10 has a slide valve 11 controlled by a temperature regulator controller (TRC) 27 which adjusts the slide valve in response to temperature at an outlet of a riser cyclone 13A. Preferably the regenerated catalyst is at a temperature of at least 1250° F. (677° C.), more preferably at least 1300° F. (704° C.), and most preferably at least 1350° F. (732° C.). Catalyst from catalyst bed 12 is entrained into the second vertical conduit 14 and passes upwardly in combination with the lift gas stream 8 to a downstream end 19 of the second vertical conduit 14. Preferably downstream end 5 and upstream end 18 are adjacent. By adjacent, it is meant that the first conduit downstream end 5 is located in the range from about 2 feet below the second conduit upstream end 18 to being inserted into the second conduit upstream end 18 by as much as about one foot. Although Conduit 5 is shown as a single conduit for illustrative purposes it should be understood that a multiplicity of smaller conduits issuing from a common manifold can be employed. A downstream end 19 of conduit 14 is located outside of the chamber 4 and within an upstream end 29 of a fluid catalytic cracking riser 20. The riser 20 also has a downstream end 31. Second conduit 14 is an acceleration conduit in which catalyst from bed 12 accelerates to a velocity of at least 4 feet per second by the time it discharges from the downstream end 19 into the riser 20. Preferably, the catalyst accelerates to at least 10 feet per second and more preferably to a range of 18 to 25 feet per second.

To achieve a desired velocity in the second conduit 14, the amount of the lift gas stream 8 passing through the first conduit 2 will vary with flowing density of regenerated catalyst stream 16 in the conduit 10 upstream of the slide valve 11. This is because at lower density there are more voids, and thus more gas, in the regenerated catalyst stream 16. The density of stream 16, upstream of the slide valve 11, is a function of the fluid catalytic cracking regenerator operating conditions, catalyst properties, catalyst flow rate, and the specific design of the unit.

The cross-sectional area of an annulus K is greater than a cross-sectional area of the second conduit 14 having a diameter B, and preferably is in the range of 1.5 to 2.5 times greater than the cross-sectional area having a diameter B. Also the elevational difference L is at least 2 feet, preferably 0.63 M plus 3 feet, where M is the diameter of chamber 4.

The downstream end 19 of conduit 14 is axially aligned with the riser 20 to form an annulus 24 therebetween. Preferably, a hydrocarbon feedstock 26 passes through hydrocarbon feedstock inlet conduit 30 which is attached to hydrocarbon feedstock distributor header 34. Header 34 is equipped with a multiplicity of equally spaced hydrocarbon distributor nozzles. Steam is mixed with feedstock 26 external to conduit 30 and issues uniformly from the nozzles in a dispersed phase or atomized flow regime. Header 34 is located within a first portion 23 of the annulus 24. A steam stream 28 may also pass into the riser 20. Preferably, steam stream 28 passes through a steam inlet conduit 36 which is attached to a steam distributor header 38 located within a second portion 25 of the annulus 24 which is upstream of the first portion 23. Hydrocarbon feedstock and steam then pass upwardly from headers 34, 38, respectively, and is uniformly and intimately mixed with the discharged catalyst and lift gas from downstream end 19 of the second conduit 14 and pass upwardly through the riser 20 to a disengaging vessel 7 (reactor vessel), shown by FIG. 1.

In the disengaging vessel 7, a mixture of catalyst and cracked hydrocarbons discharge from the riser into the riser cyclone 13A. Cyclone 13A separates a portion of catalyst from the mixture and passes the separated portion to a catalyst bed 9 located therebelow. The remainder of the mixture passes to one or more cyclones 13B in communication with an atmosphere of the vessel 7 and is then discharged from the vessel 7. Alternatively, cyclones 13A and 13B may be connected as a closed cyclone system as disclosed by U.S. Pat. No. 4,502,947 to Haddad et al and incorporated herein by reference. A closed cyclone system directly connects the cyclones to prevent mixing cracked hydrocarbon with the disengaging vessel atmosphere.

Catalyst in bed 9 is stripped by contact with stripping gas stream 15 on trays 17 in a lower portion of the vessel 7 and a spent catalyst stream 29 is discharged from vessel 7. Stream 29 passes to a catalyst regenerator vessel (not shown).

The level of catalyst bed 12 within the enclosed chamber 4 may also be regulated by a control gas stream 44 which feeds a control gas conduit 40 provided with a valve 46. Valve 46 is controlled by level controller 42 which measures catalyst level at level taps 50. Stream 44 controls catalyst level by controlling pressure within the chamber 4.

The embodiment of FIGS. 1 and 2 has advantages because it promotes a substantially uniform catalyst-to-oil (hydrocarbon feedstock) ratio across the horizontal cross-section of the riser 20. The horizontal cross-section is schematically labelled C on FIG. 2. This uniform catalyst-to-oil distribution is achieved because upstream end 18 of the second conduit 14 is immersed in the catalyst bed 12. Thus catalyst is entrained from the entire perimeter at downstream end 18 into conduit 14 while lift gas passes axially into conduit 14. This substantially uniformly mixes the catalyst and lift gas. Then the catalyst and lift gas are axially discharged from second conduit 14 into the riser 20. Furthermore, an oil and steam mixture is in the atomized and dispersed phase flow regime and preferably passes into the riser 20 through an annulus surrounding the axially injected catalyst and lift gas. This promotes substantially uniform mixing of the steam, oil, catalyst and lift gas. Such uniform mixing enhances gasoline yields by allowing increased control of the mixture passing upwardly through the riser. It also insures that a proper amount of catalyst contacts with a proper amount of oil, thereby preventing overcracking or undercracking. Gasoline yield is also enhanced and coke yield minimized because the catalyst and lift gas mixture contains light hydrocarbon and hydrogen fragments (free radicals) prior to being mixed with the oil feed. Hydrocarbon and hydrogen fragments are disclosed in U.S. Pat. Nos. 4,002,557 and 4,035,285 to Owen et al, incorporated herein by reference.

Figure 3:
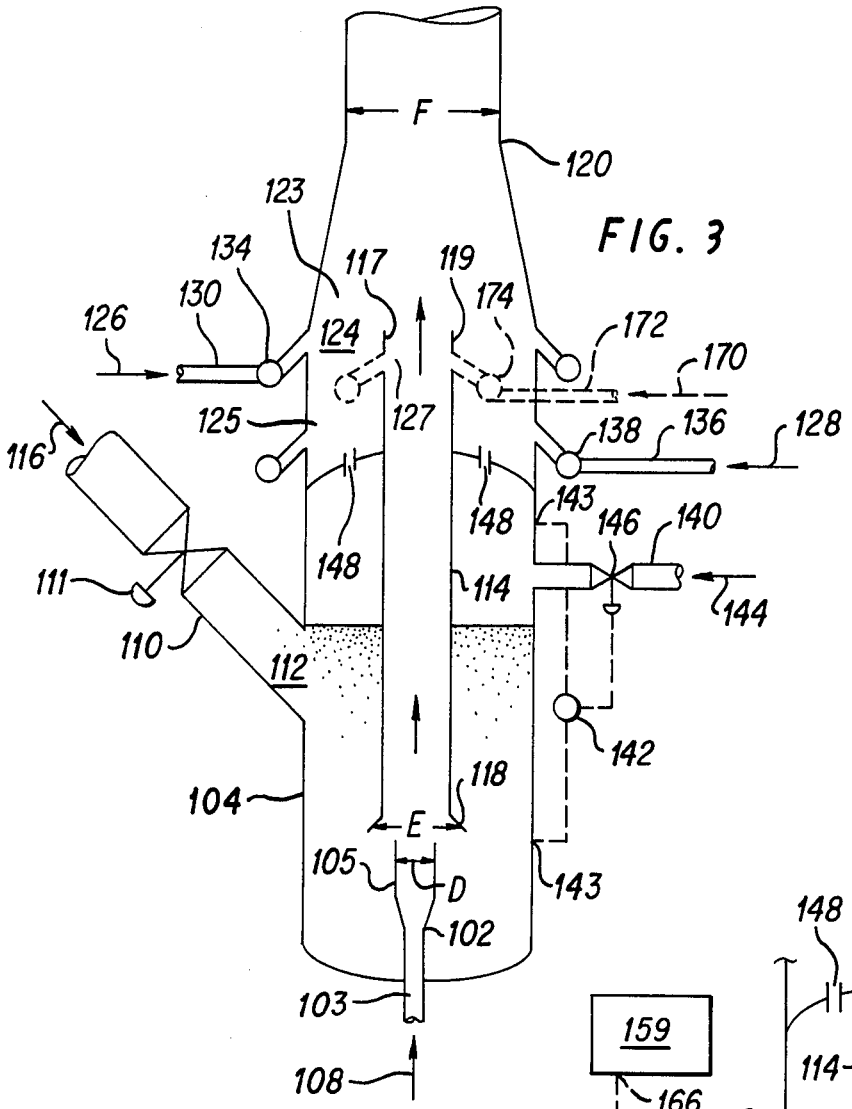
FIG. 3 is a cross-sectional view of a second embodiment of the present invention.

FIG. 3 discloses a second embodiment of the present invention. As shown by FIG. 3, a lift gas stream 108 passes into a first vertical conduit 102 having an upstream end 103 and a downstream end 105. The lift gas passes from downstream end 105 into an upstream end 118 of a second vertical conduit 114. The downstream end 105 and upstream end 118 are located within a catalyst bed 112 which is within an enclosed chamber 104. Preferably, enclosed chamber 104 is provided with vents 148. Vents 148 assist in maintaining a pressure balance between chamber 104 and a riser 120. Catalyst for catalyst bed 112 is provided by a regenerated catalyst stream 116, which may include regenerated catalyst and optionally fresh makeup catalyst. Stream 116 passes through a catalyst inlet conduit 110 having a slide valve 111. Downstream end 105 of conduit 102 has a smaller inside diameter D than the inside diameter E of upstream end 118 of conduit 114 and is axially aligned with downstream end 105. Preferably downstream end 105 of conduit 102 is adjacent upstream end 118 of conduit 114. In this context, adjacent is defined as being located from about 2 feet below upstream end 118 to being inserted about 1 foot into upstream end 118. The upstream end 118 of conduit 114 is optionally flared (frustoconical). Conduit 102 may also be a plurality of pipes. The lift gas 108 entrains catalyst from bed 112 into the downstream end 118 to form a mixture. The mixture passes upwardly to downstream end 119 of conduit 114 where it axially discharges into the riser 120.

Downstream end 119 extends upwardly out of the chamber 104 into the riser 120 and is axially aligned with riser 120 to form an annulus 124 therebetween. A hydrocarbon feedstock stream 126, optionally mixed with steam, passes into riser 120 through a hydrocarbon feedstock inlet conduit 130 attached to a header 134 in communication with a first portion 123 of the annulus 124. A steam stream 128 passes through steam inlet conduit 136 to a steam header 138 in communication with a second portion 125 of the annulus 124. The second portion 125 is upstream of the first portion 123. Rather than pass the hydrocarbon stream 126 into the annulus 124, a hydrocarbon feedstream 170 may optionally be provided which passes through a hydrocarbon inlet conduit 172 attached to a hydrocarbon distributor header 174. Header 174 passes hydrocarbon feed 170 to an annulus 127 within downstream end 119 along an inside wall 117 of downstream end 119.

The level of catalyst bed 112 may be controlled by control gas stream 144 which passes through a control gas conduit 140 into the atmosphere of the chamber 104. Stream 144 controls the level of catalyst bed 112 by controlling the pressure in chamber 104. Conduit 140 is provided with a control valve 146 controlled by level controller 142 in communication with level taps 143 attached to chamber 104. In combination with stream 144 or as an alternative to employing stream 144, slide valve 111 may also be employed to control the level of bed 112.

The embodiment shown in FIG. 3 results in a substantially uniform catalyst to hydrocarbon feedstock ratio across a horizontal riser cross-section F. Also it has particular advantages because the oil can be fed directly to an annular region within the downstream end 119 of the second vertical conduit 114 or fed to an annulus 124 surrounding the outside of the downstream end 119. This provides greater flexibility when designing the apparatus for performing the process of the present invention.

Figure 4:
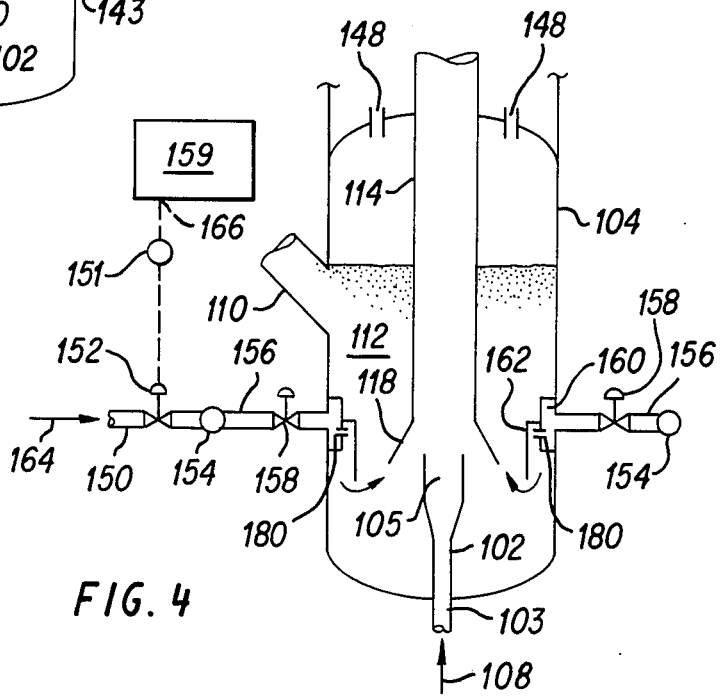
FIG. 4 is a cross-sectional view showing the embodiment of FIG. 3 with a modified control gas system.

FIG. 4 shows a modification of the level controller of FIG. 3. FIG. 4 shows a control gas stream 164 which passes into a control gas conduit 150 provided with a valve 152 and attached to a header 154 which surrounds the chamber 104. Header 154 is attached to a multiplicity of second control gas conduits 156 which may each be provided with valves 158. Conduits 156 discharge stream 164 into a chamber 160 located within the enclosed chamber 104. The gas from chamber 160 is discharged beneath a baffle 162 through flow distributing orifices 180. The baffle 162 directs control gas stream 164 downwardly within the catalyst bed 112. Preferably baffle 162 is located in a portion of enclosed chamber 104 which is lower than catalyst inlet conduit 110. Valve 152 is controlled by a level controller 151 which communicates with level taps 166 attached to a fluid catalytic cracking reactor, schematically represented as member 159.

The embodiment shown by FIG. 4 has particular advantages in providing a more uniform distribution of control gas within the chamber 104. FIGS. 3 and 4 show that the regenerated catalyst slide valve 111 may be employed to control catalyst level in a fluid catalytic cracking disengaging vessel (such as vessel 7 of FIG. 1) by controlling catalyst level in the chamber and the catalyst rate from the regenerator (not shown). However, alternatively or in combination with the slide valve 111, the light hydrocarbon control gas of FIGS. 1–4 can control the catalyst rate from the regenerator and chamber catalyst level, thereby controlling the disengaging vessel catalyst level.

Figure 5:
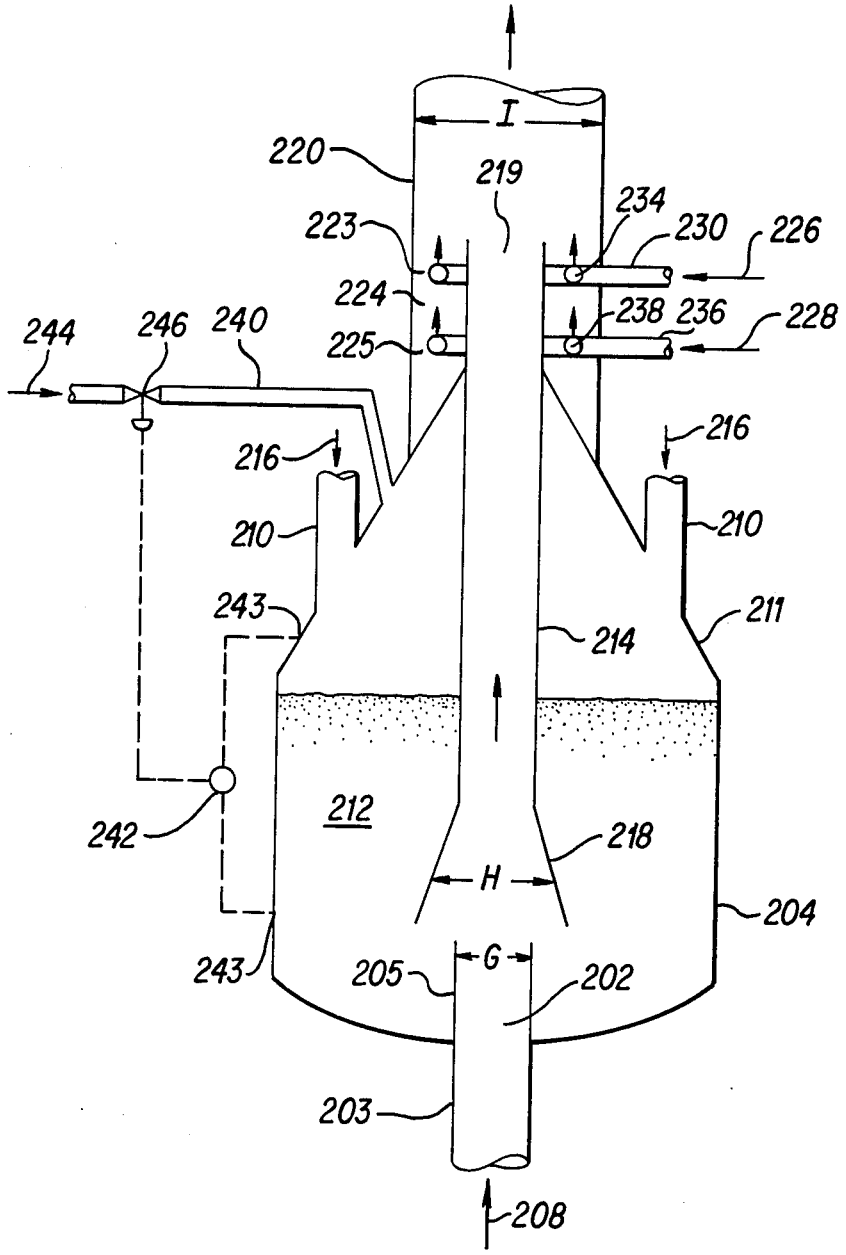
FIG. 5 shows a third embodiment of the present invention.

FIG. 5 discloses a third embodiment of the present invention. As shown in FIG. 5, a lift gas stream 208 passes into an upstream end 203 of a first vertical conduit 202 and discharges from a downstream end 205 of conduit 202. Preferably stream 208 includes a mixture of hydrocarbons having less than 4 carbon atoms per molecule, steam, and either residuum, virgin vacuum gas oil, or cracked cycle stock. Conduit 202 is axially aligned with a second vertical acceleration conduit 214 so that lift gas passes axially into an upstream end 218 of second conduit 214. The upstream end 218 of conduit 214 is optionally flared (frustoconical). Downstream end 205 and upstream end 218 are surrounded by a catalyst bed 212 so that catalyst is entrained upwardly into upstream end 218 and mixes with lift gas stream 208. Downstream end 205 has an inside diameter G which is smaller than an inside diameter H of upstream end 218. The catalyst then discharges from a downstream end 219 of the conduit 214. The catalyst in conduit 214 is accelerated to a velocity of at least 4 feet per second, preferably at least 10 feet per second and more preferably to a velocity of 18 to 25 feet per second prior to being discharged from downstream end 219. Catalyst stream 216 from a regenerator vessel (no shown) passes in free fall through catalyst inlet conduits 210 attached to a top wall 211 of an enclosed chamber 204.

The level of the catalyst bed 212 may be maintained by a control gas stream 244 which passes through a control gas conduit 240 into an atmosphere of the chamber 204. The control gas stream 244 preferably comprises hydrocarbons having at most 4 carbon atoms per molecule or fuel gas. Typically, fuel gas includes methane or ethane. The flow of the control gas stream 244 is controlled by a valve 246 attached to a control gas conduit 240. Valve 246 is controlled by a level controller 242 in communication with level taps 243 attached to the enclosed chamber 204.

Conduit 214 is axially aligned with riser 220 so that catalyst discharges from downstream end 219 axially into the riser 220. An annulus 224 is defined between the riser 220 and downstream end 219. A hydrocarbon feedstock 226 passes through a hydrocarbon feedstock conduit 230 to a hydrocarbon feedstock distributor 234 located in a first portion 223 of the annulus 224. A stream stream 228 passes through a steam conduit 236 to a steam distributor header 238 which is preferably located in a second portion 225 of the annulus 224 which is upstream of the first portion 223. The steam stream 228 and hydrocarbon feedstock 226 pass upwardly through the annulus 224 and mix with the axially passing catalyst and lift gas from downstream end 219 of conduit 214. This forms a mixture having a substantially constant hydrocarbon feedstock to catalyst ratio across the horizontal cross-section I of riser 220. This mixture then passes upwardly through the riser at fluid catalytic cracking conditions comprising a temperature of at least 1000° F. to form a mixture of the catalyst and cracked hydrocarbon product. Preferably the regenerated catalyst stream 216 has a temperature of at least 1300° F. (704° C.), more preferably at least 1350° F. (732° C.).

Figure 6:
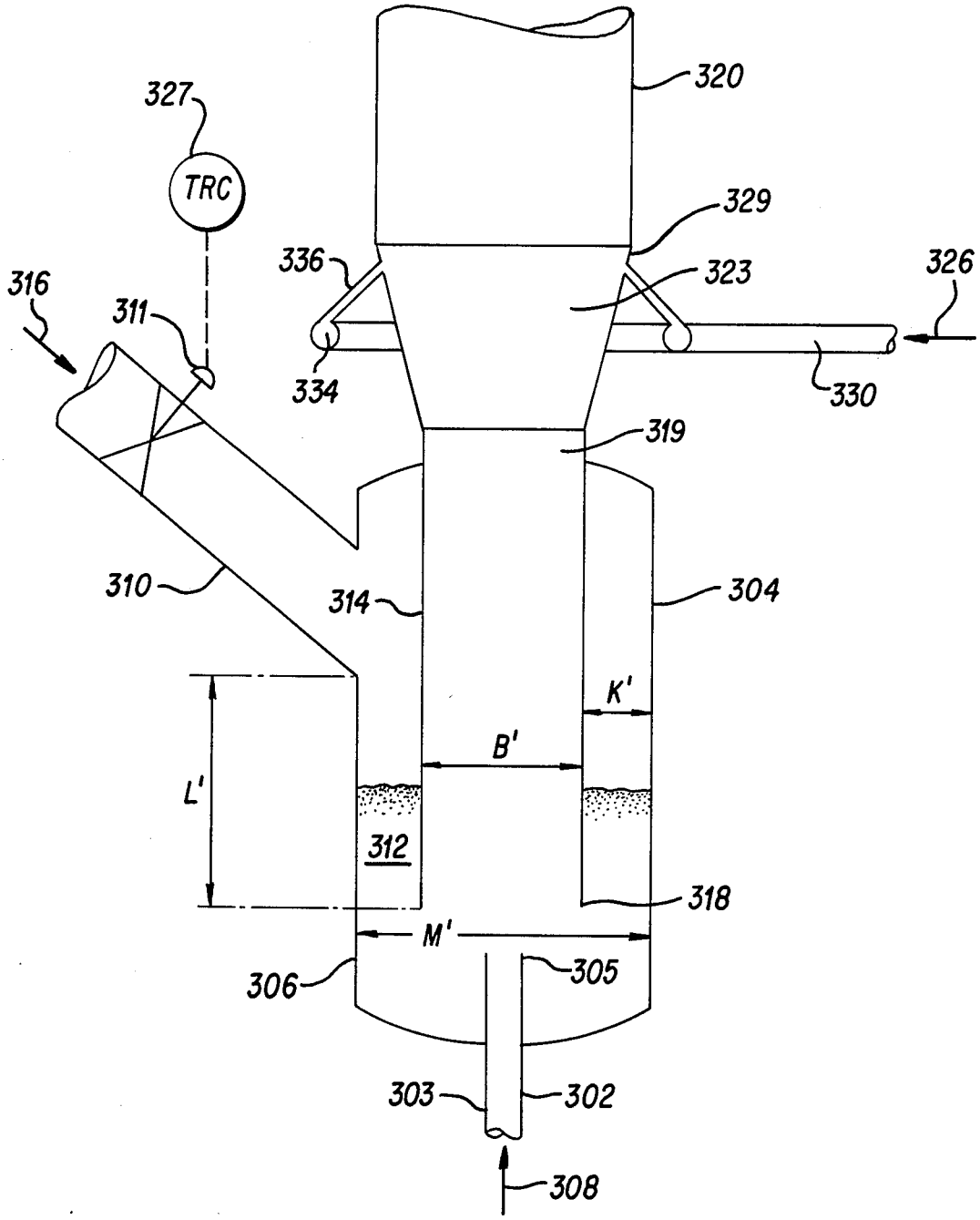
FIG. 6 shows a fourth embodiment of the present invention.

FIG. 6 shows a preferred embodiment of the present invention. A conduit 310 has a valve 311 to control the desired catalyst rate of a catalyst stream 316 therethrough. The valve 311 is upstream of the junction of a sidewall 306 of an enclosed chamber 304 and the conduit 310. The valve has an opening set for the desired rate and preferably is actuated by a temperature regulator controller (TRC) 327 with an indicator located at the exit of a riser cyclone such as cyclone 13A (of FIG. 1). The level of a catalyst bed 312 within the enclosed chamber 304 will seek a level which is below the valve 311 in conduit 310 and above an upstream end 318 of a second vertical conduit 314 which is axially aligned with a first vertical conduit 302. A lift gas stream 308 passes into an upstream end 303 of the first conduit 302, discharges from a downstream end 305 of the first conduit 302, and passes directly into the upstream end 318 of the second conduit 314. The catalyst from the bed 312 will flow uniformly through an inner periphery of the upstream end 318 of second conduit 314 and through second conduit 312. Rather than employ a single conduit 302 as shown, a multiplicity of conduits may 302 may inject lift gas into second conduit 314.

A stream 326 of oil and steam passes through a conduit 330 to a header 334. Header 334 is provided with a multiplicity of nozzles 336 which atomize the oil and steam and disperse the atomized oil and steam through an annular region 323 about an inner periphery of an upstream end 329 of a riser 320. Downstream end 319 of the second conduit 314 is attached to the upstream end 329 of the riser 320.

The area of an annulus K' between second conduit 314 and sidewalls 306 is greater than the area of a horizontal cross-section of the second conduit 314 having a diameter B', and preferably annulus K' has an area in the range of 1.5 to 2.5 times greater than the cross-sectional area having a diameter B'. Also an elevational difference L' is at least 2 feet, preferably $0.63M'+3$ feet, where M' is the diameter of the chamber 304.

All the embodiments of the present invention described above have the advantage of substantially uniform catalyst-to-oil (hydrocarbon feedstock) ratio across the horizontal cross-section of a fluid catalytic cracking riser. The catalyst-lift gas mixture is also in transport phase flow condition with an average void volume between catalyst particles in the range of 55 to 85 percent depending on specific design and operating conditions prior to being mixed with the steam and atomized oil mixture to be cracked. This is a significant advantage because it results in better control of the oil and catalyst at fluid catalytic cracking conditions thus achieving maximum gasoline yield and minimum coke yield by preventing overcracking or undercracking. The embodiment of FIG. 6 also has the advantage that it controls the level of bed 312 without control gas.

While specific embodiments of the process and apparatus aspects of the invention have been shown and described, it should be apparent that many modifications can be made thereto without departing from the spirit and scope of the invention. Accordingly, the invention is not limited by the foregoing description, but is only limited by the scope of the claims appended hereto.

We claim:

1. A process for mixing fluid catalytic cracking catalyst and hydrocarbon feedstock comprising the steps of:

passing a first stream of said catalyst into a catalyst bed in an enclosed chamber;

passing lift gas through a first vertical conduit into said enclosed chamber;

axially passing said lift gas from said first conduit into an upstream end of a second vertical conduit, said upstream end of said second conduit being immersed in said bed;

passing said catalyst from said bed along with said lift gas into said second conduit;

accelerating said catalyst through said second conduit;

axially passing said catalyst and lift gas from said chamber, to an upstream end of a fluid catalytic cracking riser, through said second conduit, said riser comprising an elongated tubular vessel;

atomizing said hydrocarbon feedstock and passing said atomized hydrocarbon feedstock in annular flow about an inner periphery of said riser upstream end;

combining said hydrocarbon feedstock, catalyst and lift gas in said riser to form a mixture; and upwardly passing said mixture through said riser at fluid catalytic cracking conditions.

2. The process of claim 1, wherein said hydrocarbon feedstock passing step comprises passing said hydrocarbon feedstock about a perimeter of said downstream end of said second conduit through an annulus defined between said riser and said second conduit, said catalyst bed surrounding a perimeter of said second conduit upstream end;

said process further comprising passing steam through said annulus;

wherein said second conduit upstream end has a larger inside diameter than an inside diameter of a downstream end of said first conduit.

3. The process of claim 1, said hydrocarbon feedstock passing step comprising passing said hydrocarbon feedstock in annular flow within said second conduit.

4. The process of claim 1, further comprising passing steam into said riser periphery, wherein said riser is attached to said second conduit.

5. The process of claim 1, wherein said lift gas is selected from the group consisting of steam, gasoline, flue gas from a fluid catalytic cracking regenerator, a second hydrocarbon feed stream, vacuum gas oil, residuum, cracked cycle stock, fuel gas and hydrocarbons having at most four carbon atoms per molecule.

6. The process of claim 1, wherein said lift gas comprises a mixture of hydrocarbons having at most 4 carbon atoms per molecule, steam and a member selected from the group consisting of residuum, virgin vacuum gas oil, and cracked cycle stock.

7. The process of claim 5, wherein said catalyst is accelerated in said second conduit to a velocity of at least 4 feet per second.

8. The process of claim 7, wherein said velocity is at least 10 feet per second.

9. The process of claim 8, wherein said first stream of catalyst passes at a temperature of at least 1300° F. into said enclosed chamber and said velocity is in the range from 18 to 25 feet per second.

10. The process of claim 9, wherein said first conduit downstream end is adjacent said second conduit upstream end.

11. The process of claim 10, further comprising passing a control gas stream, comprising a member selected from the group consisting of fuel gas and hydrocarbons having at most 4 carbon atoms per molecule, into an atmosphere of said chamber.

12. The process of claim 11, wherein said first stream of catalyst passes downwardly into said enclosed chamber in free fall.

13. The process of claim 10, further comprising passing a control gas stream, comprising a member selected from the group consisting of fuel gas and hydrocarbons having at most 4 carbon atoms per molecule, into said catalyst bed within said chamber.

14. The process of claim 10, wherein said first catalyst stream passes into said enclosed chamber through a catalyst conduit attached to a sidewall of said enclosed chamber and said upstream end of said second conduit is at least 2 feet below where said catalyst conduit is attached to said enclosed chamber sidewall.

15. The process of claim 14, wherein said second conduit upstream end is, at least 0.63 times an inner diameter of said chamber plus 3 feet, below where said catalyst conduit is attached to said enclosed chamber sidewall.

16. A process for mixing fluid catalytic cracking catalyst and hydrocarbon feedstock, comprising the steps of:

passing said catalyst through a catalyst conduit attached to a sidewall of an enclosed chamber, at a temperature of at least 1300° F., into a catalyst bed located in a lower portion of said enclosed chamber;

passing lift gas comprising hydrocarbons having at most four carbon atoms per molecule, steam, and a member of the group consisting of residuum, virgin vacuum gas oil, and cracked cycle stock through a first vertical conduit into said enclosed chamber;

axially passing said lift gas from a downstream end of said first conduit into an upstream end of a second vertical conduit, said first conduit downstream end having a smaller inside diameter than that of said second conduit upstream end, said second conduit upstream end being located, at least 0.63 times an inner diameter of said enclosed chamber plus 3 feet, below where said catalyst conduit is attached to said enclosed chamber;

passing said catalyst from said catalyst bed along with said lift gas into said second conduit upstream end, a perimeter of said second conduit upstream end being surrounded by said catalyst bed;

accelerating said catalyst in said second conduit to a velocity in the range from 18 to 25 feet per second;

axially passing said catalyst and lift gas through said second conduit from said chamber to a fluid catalytic cracking riser, said riser being an elongated tubular vessel attached to said second conduit;

passing steam and said hydrocarbon feedstock, in annular flow in atomized form, into said riser about an inner periphery within an upstream end of said riser;

combining said steam, hydrocarbon feedstock, catalyst and lift gas in said riser to form a mixture having a substantially uniform catalyst to hydrocarbon feedstock ratio across a horizontal cross-section of said riser; and upwardly passing said mixture through said riser at fluid catalytic cracking conditions.

* * * * *